US010450185B2

(12) United States Patent
Cross et al.

(10) Patent No.: US 10,450,185 B2
(45) Date of Patent: Oct. 22, 2019

(54) HORSE BIT

(71) Applicant: Neue Schule Limited, Stokesley, North Yorkshire (GB)

(72) Inventors: Graham Hugh Cross, Stockton-on-Tees (GB); Heather Jayne Margaret Hyde-Saddington, Stokesley (GB)

(73) Assignee: Neue Schule Limited, North Yorkshire (GB)

( * ) Notice: Subject to any disclaimer, the term of this patent is extended or adjusted under 35 U.S.C. 154(b) by 395 days.

(21) Appl. No.: 15/116,451

(22) PCT Filed: Feb. 5, 2015

(86) PCT No.: PCT/EP2015/052384

§ 371 (c)(1),
(2) Date: Aug. 3, 2016

(87) PCT Pub. No.: WO2015/121142

PCT Pub. Date: Aug. 20, 2015

(65) Prior Publication Data

US 2017/0166433 A1 Jun. 15, 2017

(30) Foreign Application Priority Data

Feb. 11, 2014 (EP) ..... 14154701

(51) Int. Cl.
*B65B 1/06* (2006.01)
*B68B 1/06* (2006.01)

(52) U.S. Cl.
CPC ..... *B68B 1/06* (2013.01)

(58) Field of Classification Search
CPC ..... B68B 1/06
See application file for complete search history.

(56) References Cited

U.S. PATENT DOCUMENTS 1,806,483 A * 5/1931 Meyer ..... B68B 1/06 54/8
3,623,294 A * 11/1971 Stone et al. ..... B68B 1/06 54/8

(Continued)

FOREIGN PATENT DOCUMENTS

DE 20 2013 104370 U1 10/2013
EP 1140693 B1 11/2003

(Continued)

OTHER PUBLICATIONS

International Preliminary Report on Patentability for corresponding PCT/EP2015/052384 dated Aug. 25, 2016.

(Continued)

*Primary Examiner* — Kathleen I Alker
(74) *Attorney, Agent, or Firm* — Alfred Y. Chu, Esq.; Brian B. Shaw, Esq.; Harter Secrest & Emery LLP

(57) ABSTRACT

The invention relates to a horse bit (10, 210) comprising a shackle (20, 220) configured to be inserted into a horse's mouth. The shackle comprises at least one joint (30, 40; 230) and two side portions (50, 60, 250, 260), wherein the two side portions are connected by the at least one joint such that the side portions are pivotable to each other, and at least two eyelet members (80, 90, 100, 110; 280, 290) each having an eyelet bore (82, 92, 102, 112; 282, 292), wherein the eyelet members are interlocked with play via their eyelet bores to provide the at least one joint. Further, in a cross section in the range of one of the eyelet members along or substantially parallel to an axis of the eyelet bore a cross-sectional width (W1, W2) of the one eyelet member is larger than the inner width (W3) of the eyelet bore of the other eyelet member.

19 Claims, 7 Drawing Sheets

(56) References Cited

U.S. PATENT DOCUMENTS

| | | | | |
|---|---|---|---|---|
| 4,375,147 | A * | 3/1983 | Conrad | B68B 1/06 54/8 |
| 6,425,229 | B2 | 7/2002 | Sprenger et al. | |
| 6,848,242 | B2 * | 2/2005 | Chang | B68B 1/06 54/9 |
| 8,393,134 | B2 * | 3/2013 | Morgante | B68B 1/06 54/8 |
| 2004/0200196 | A1 | 10/2004 | Hsi-Chang et al. | |
| 2008/0250760 | A1 * | 10/2008 | Hyde-Saddington | B68B 1/06 54/8 |
| 2013/0312375 | A1 | 11/2013 | Gaudet | |
| 2017/0044000 | A1 * | 2/2017 | Voellmecke | B68B 1/06 |

FOREIGN PATENT DOCUMENTS

| | | | | |
|---|---|---|---|---|
| GB | 191200880 | A * | 8/1912 | B68B 1/06 |
| WO | 03/018463 | A1 | 3/2003 | |

OTHER PUBLICATIONS

International Search Report for PCT/EP2015/052384 dated Apr. 7, 2015.
Written Opinion for PCT/EP2015/052384 dated Apr. 7, 2015.

* cited by examiner

HORSE BIT

The present invention relates to a horse bit, in particular to the mouthpiece or shackle of the horse bit. The horse bit can also be designated as snaffle bit for a horse.

EP 1 140 693 B1 discloses a horse bit comprising a shackle configured to be inserted into a horse's mouth. In one embodiment a single jointed horse bit comprises two elongated side portions whose inner ends provide eyelets for interlocking and forming a joint similar to that seen in a chain-link system. This embodiment provides a single joint with free play to allow the mouthpiece to adopt a large range of positions within the mouth. The interlocking eyelets are designed to allow such freedom. In another embodiment a double jointed horse bit comprises two elongated side portions whose inner ends provide eyelets for joining loosely to a central portion which itself contains eyelets to receive the side portion eyelets to form two joints. This embodiment provides for two joints connecting the side portions to the central portion each having free play around a large range of 3-dimensional angles. The central portion is designed to allow such freedom.

In general, double jointed horse bits provide the advantage over single jointed horse bits by reducing the nutcracker action described by unrestrained pressure of the single joint structure across the tongue of the horse when rein tension is applied.

The free play in the joints of the single or double jointed bits provides the angular range of rotation of the two side portions necessary to convey speed commands and directional commands to the horse from the rider through the reins.

Tongue pressure variation is predominantly the basis of commands to control speed and is provided upon bilateral tensioning of the reins by the freedom of the side portions of the bit to close across the tongue and bars of the lower jaw of the horse. Unequal tensioning of the two reins is the basis of commands to indicate direction changes to the horse.

What has not been accounted for is that the allowance of this free play around a large range of angles brings the possibility that the horse can push up the side portions of the bit with its tongue so that it can then be pulled back along the mouth and then clamped between the pre-molars. This leads to a loss of utility of the bit and can create an unsafe situation due to the lack of control. This disadvantage allows the horse to clamp the bit between the teeth and thus prevent effective rein aids from being applied.

It is an object of the invention to provide a horse bit with a limited range of free play within the horse's mouth so as to suppress or prevent the horse pushing up the shackle or the side portions of the bit with its tongue so that it can then be pulled back along the mouth and then clamped between the pre-molars. At the same time the horse bit should provide an appropriate angular range of rotation of the two side parts necessary to convey speed commands and directional commands from the rider to the horse through the reins connected to the side portions.

SUMMARY OF THE INVENTION

The above object is achieved by a horse bit according to claim 1. According to the present invention, the horse bit comprises a shackle configured to be inserted into a horse's mouth, wherein the shackle has at least one joint and two side portions, wherein the two side portions are connected by the at least one joint such that the side portions are pivotable to each other and at least two eyelet members each having an eyelet bore, wherein the eyelet members are interlocked with play via their eyelet bores to provide the at least one joint. Further, in a cross section in the range of one of the eyelet members and along or (substantially) parallel to an axis of the eyelet bore the cross-sectional width of the one eyelet member is larger than the inner width of the eyelet bore of the other eyelet member.

The horse bit according to the invention preferably is a single jointed horse bit, i.e. comprises exactly one joint, or is a double jointed horse bit, i.e. comprises exactly two joints. However, also multiple jointed horse bits, i.e. having more than two joints, are possible embodiments according to the present invention. Further, it is possible to have more than two side portions and/or more than one central portion. Preferably, two eyelet members are interlocked with play via their two eyelet bores to provide one joint. In case of two or more joints, two eyelet members are interlocked with play via their two eyelet bores to provide one joint, respectively.

Preferably, both the cross-sectional width of the one eyelet member and the inner width of the eyelet bore of the other eyelet member are measured in the plane of the cross section. The cross-section preferably is a vertical cross section. Preferably, the plane of the cross-section extends in directions which are substantially perpendicular to the length axis of the shackle.

In this connection the shackle preferably is in a stretched position and/or preferably in a position laid on a planar horizontal surface. Alternatively or additionally the cross-section refers to a position of the shackle where the inner surface of the one eyelet member mates or contacts the inner surface of the other eyelet member. The cross-sectional width can preferably be understood as a dimension measured in the plane of the cross-section in the range of one of the eyelet members, in particular in the range of one of the eyelet bores.

As to the further general understanding of the present invention, the shackle generally extends in a length direction along the length axis of each of the two side portions and, if present, along a length axis of a central portion. This applies in particular when the bit is stretched. This overall longitudinal axis can extend as a straight and/or curved line. The shackle has an upper side related to the roof of the horse's mouth and a lower side related to the lower jaw of the horse's mouth. Further, the shackle generally extends in a height direction which is perpendicular to the length direction and corresponds to the vertical direction.

Further, referring to the terms used in the present invention, the shackle can also be designated as a mouthpiece. The side portions may also be designated as side parts or side arms and/or the central portion as a center part.

The side portions can have a curved shape along their length axes. Preferably, the curvature is convex such that the center of curvature lies below the horse's tongue. Each side portion can have several adjacent or side-by-side sections having different but continuously merging curvatures. For example, the outer end can be curved concave, the inner end can be curved convex and the section in between can be curved convex and/or concave. Thus, the shackle as a whole can adopt a curved orientation in the horse's mouth.

Preferably, each side portion has an outer end with a hole for receiving a side ring and/or a side bar, in particular in such a manner as to allow the side ring (or side bar) to move freely, for connecting the reins to the horse bit. The axes of the two outer holes preferably define a plane, which is preferably horizontal. Preferably, the axes of the outer holes extend perpendicular to the longitudinal axis of each side portion and/or to the longitudinal or length axis of the shackle.

In a further preferred configuration, the cross-sectional width of the eyelet member substantially extends perpendicular to the longitudinal or length axis and/or in the plane defined by the two holes of the outer ends of the side portions.

EFFECTS OF THE INVENTION

One effect of the relationship between the cross-sectional width of the one eyelet member and the inner width of the eyelet bore of the other eyelet member is that the range of rotation of at least one of the side portions relative to the other side portions and/or relative to a possible central portion between the two side portions is restricted or limited. In other words, the interdependence of the two cross-sectional dimensions serves as a rotation restriction means in a certain range.

As a consequence thereof the horse cannot so easily raise the shackle to push up the side portions of the bit with its tongue so that it can then be pulled back along the mouth and then clamped between the pre-molars. However, as the range of free play within the mouth related to the tongue is still possible, the side portions and/or the central portion can still interact with the tongue depending on the commands given by the rider via pulling the reins.

The invention describes an improvement to single, double or multiple jointed horse bits by acting to substantially remove an undesirable feature, namely that of the horse lifting the bit with its tongue and translating it backwards in the mouth to the regions where the wolf teeth and premolars lie.

The advantages include the reduction of damage to the teeth caused by the chewing action a reduction therefore of the discomfort due to vibration-induced acoustic shock and the provision of a more comfortable surface where the bit meets the roof of the mouth.

In a yet further additional advantage the usefulness of the invention is further emphasised when one realizes that the additional problem of the horse clamping the bit between the teeth is that when the bit material is somewhat soft as in plastic horse bits this undesirable feature can lead to removal of material that if unchecked can lead to catastrophic failure of the mouthpiece.

The invention provides a means for restricting the upwards rotation of the side portions of a jointed horse bit to prevent it being translated backwards in the horse's mouth and thereby being clamped by the teeth.

The restriction in rotations upwards is provided by a progressive or abrupt widening in the cross section of one of the end sections of the two components forming the linked pair by the interlocking of their respective eyelets. The component possessing this widening feature hereafter alternatively can be designated as the "controlling part". As the external width of the end section of the controlling part increases along the vertical direction a critical width occurs where it matches the internal width of the eyelet bore of the other part (side portion or central portion) which hereafter alternatively can be designated as the "controlled part".

Rotations of the controlled part relative to the controlling part are centred on the mating point between the two parts. When the controlled part of the linked pair is induced to rotate around angles where the mating point is the sole contact point between the two parts there is free rotation. By controlling the vertical position of the critical width in the end section of the controlling part the range of angles that allow free rotation can be limited. What needs to be appreciated to solve this problem whilst retaining all the advantages of joints having free play is that the angular range of free rotation of each of the two side portions required for directional and speed control preferably all lie within only a single quadrant of the hemisphere whose origin lies at the point where the eyelets interlock to form the joint. In other words, only a single quadrant of free rotation is required for directional and speed control.

The hemisphere can be defined that is centred on the mating point or origin and which contains the full range of 3-dimensional angles into which free rotation is allowed each of which is defined using a vector construction between the origin and the general spherical surface with each angle defined by the vector projection onto the 3 orthogonal axes of a Cartesian coordinate system also centred at the mating point. One of the axes may be defined as the vertical direction. Positive values for points along this axis lie in the upper quadrant of the hemisphere whilst negative values lie in the lower quadrant of the hemisphere.

The invention describes the removal of free rotation angles from the full range of 3-dimensional angles into which free rotation is allowed. The removed angles preferably are defined by the projections onto the Cartesian axis system of vectors constructed between the origin of the hemisphere and the hemispherical surface where the component of projection onto the vertical direction has a positive scalar value. In other words, preferably the removed angles are those that lie in the upper quadrant of the hemisphere.

By this means an asymmetric restriction in free rotation in the vertical direction of the controlled parts of jointed bits is provided and this serves to solve one object of the invention that of preventing the loss of control of the horse by the rider by the horse being able to clamp the bit between the teeth.

In an additional advantage the lessening of the clamping of the bit between the teeth reduces the physical impact of the bit on the teeth which transfers an uncomfortable acoustic shockwave into the bones of the jaw and further-more can lead to damage to the teeth.

Preferred embodiments of the horse bit of the present invention are defined in claims 2 to 15 and will be further explained below.

According to a preferred embodiment, the cross-sectional width of the eyelet member (of the controlling part) is equal to or larger than the inner width of the eyelet bore of the other eyelet member at one position of the eyelet member or over a section of the eyelet member than at other positions or sections. Preferably, the cross-sectional width of the eyelet member is continuously increasing over the cross-sectional height of the eyelet member.

According to a further preferred embodiment, at least one of the eyelet members includes a ring portion having an upper ring section related to the roof of the horse's mouth and a lower ring section related to the lower jaw of the horse's mouth, wherein a thickness of the upper ring section is larger than a thickness of the lower ring section. Preferably, the afore-mentioned eyelet member is orientated such that its eyelet bore axis extends in the horizontal direction.

In a further preferred embodiment, the thickness of the ring portion is continuously increasing along the longitudinal extension axis of the ring portion. In other words, the thickness of the ring member (or eyelet member) can increase along its arc-shaped or circular middle axis. One could also say that the ring portion of the eyelet member has a first cross-sectional dimension which is greater than a second cross-sectional dimension of the ring portion of the other eyelet member. Thus, the cross-sectional width preferably extends in the thickness direction of the corresponding eyelet member.

In a further preferred embodiment, at least one of the eyelet bores has a substantially circular shape with an inner diameter as the inner width.

According to a further preferred embodiment, at least one of the eyelet members is at least partially ring-shaped and/or the at least two side portions are arm-shaped.

According to a further preferred embodiment, an angular range of free rotation of each of the two side portions lies within only a single quadrant, preferably the lower quadrant, of a hemisphere whose origin lies at a mating contact point where inner surfaces of the eyelet bores interlock and contact each other to form the joint.

In a further preferred embodiment, the cross-sectional width is formed by at least one projection section provided by or connected to one of the eyelet members.

According to a further preferred embodiment, the at least one projection section extends substantially parallel to the axis of one of the eyelet bores.

In a further preferred embodiment, the cross-sectional width of the one eyelet member is variable over the plane of the cross section, wherein a first cross-sectional width is about at least 50%, preferably at least 75% and more preferably at least 90% or 95% of the inner width of the eyelet bore of the other eyelet member, and wherein a second cross-sectional width is more than 100%, preferably at least 125% and more preferably at least 150%, of the inner width of the eyelet bore of the other eyelet member, and wherein at one position or over a section in the plane of the cross-section between the first and second cross-sectional width a third cross-sectional width corresponds to the inner width of the eyelet bore of the other eyelet member.

Preferably, the first cross-sectional width is the minimum cross-sectional width of the one eyelet member, the second cross-sectional width is the maximum cross-sectional width of the one eyelet member and/or the third cross-sectional width is the cross-sectional width which is identical to the inner width of the eyelet bore of the other eyelet member.

As to further preferred relationships, the thickness of the ring portion of the one eyelet member is preferably in a range of between about more than 75% and less than 100% of the diameter of the eyelet bore of the other eyelet member and more preferably in a range of between about more than 80% and less than 95%. Moreover, the inner diameter of the eyelet bore one eyelet member is preferably in a range of between about more than 75% and less than 100% of the diameter of the eyelet bore of the other eyelet member and more preferably in a range of between about more than 80% and less than 95%.

According to a further preferred embodiment, the shackle comprises one joint wherein the two side portions are connected by the one joint and each side portion having an inner end with one eyelet member having the eyelet bore, wherein the two eyelet members are interlocked with play via their eyelet bores to provide the one joint. In this embodiment (single-jointed bit), the two side portions can be designated as a first and a second side portion. Moreover, the eyelet member of the first side portion can be designated as first eyelet member having the first eyelet bore and the eyelet member of the second side portion can be designated as second eyelet member having the second eyelet bore.

In a preferred configuration, one of the inner ends of the side portions, in particular the eyelet member, has a top surface related to the horse palatine wherein the top surface is flattened and/or curved and/or enlarged. Preferably, the ring portion and more preferably it's upper ring section comprises this top surface. This flattened upper surface is advantageous in that it presents a more comfortable contact with the roof of the horse's mouth by virtue of its relatively large surface area.

In a further preferred embodiment, the shackle comprises a central portion between the two side portions and two joints for connecting the central portion to the side portions, each side portion having an inner end with one eyelet member having one eyelet bore, and the central portion having two end sections wherein each end section has one eyelet member with one eyelet bore, wherein each eyelet member of one end section is interlocked with play with the adjacent eyelet member of one side portion to provide a joint. In this embodiment (double-jointed bit), the two side portions can be designated as a first and a second side portion, as mentioned above with regard to the single-jointed bit. Moreover, the eyelet member of the first side portion can be designated as first eyelet member having the first eyelet bore. Further, the eyelet member at a first end section of the central portion can be designated as the second eyelet member which interlocks with the first eyelet bore of the first eyelet member. Further, the eyelet member at a second end section of the central portion can be designated as the third eyelet member having a third eyelet bore and the eyelet member of the second side portion can be designated as fourth eyelet member which interlocks with its fourth eyelet member with the third eyelet bore.

In a further preferred embodiment, the two eyelet members of the central portion are integrally formed as a one-piece central portion (or part). Preferably, the two eyelet members can be connected via a connecting portion.

In a further preferred embodiment, the central portion has a top surface related (and faced) to the horse palatine wherein the top surface is flattened, curved and/or enlarged. This flattened upper surface is advantageous in that it presents a more comfortable contact with the roof of the horse's mouth by virtue of its relatively large surface area.

The description of the invention that follows will be made preferably in terms of double jointed horse bits but it will be apparent to the skilled person that the principles of the invention will equally well apply to single jointed horse bits and to multiple jointed horse bits in general. It will be instructive to relate the engineering planes and axes of relevance to the invention to the anatomical features of the horse's head. The joint or the joints of the horse bit rests on the upper surface of the horse's tongue. This anatomical surface defines a convenient reference plane with the roof of the mouth lying above the reference plane and the lower jaw lying below the reference plane.

DETAILED DESCRIPTION OF PREFERRED EMBODIMENTS

In the following the invention will be explained, by way of two preferred embodiments, in more detail with reference to the drawings, wherein FIG. 1 is a perspective view of two side portions of a first embodiment of a horse bit according to the present invention;

FIG. 7 is a further cross-sectional view of the central portion shown in

Figure 2:
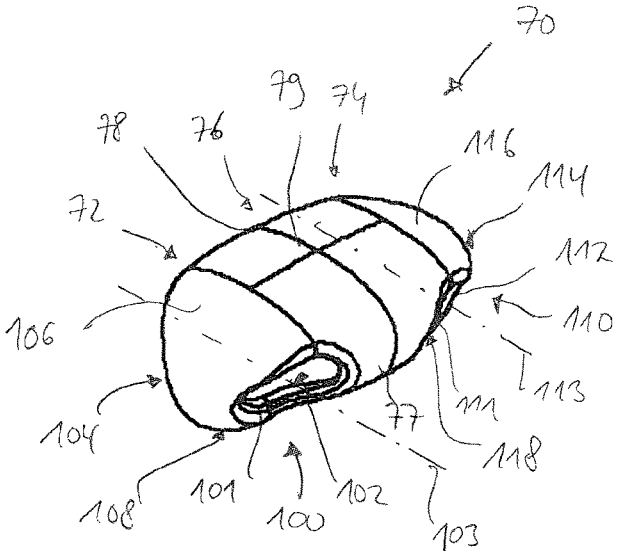
FIG. 2 is a perspective view of a central portion of the first embodiment of the present invention.
Figure 3:
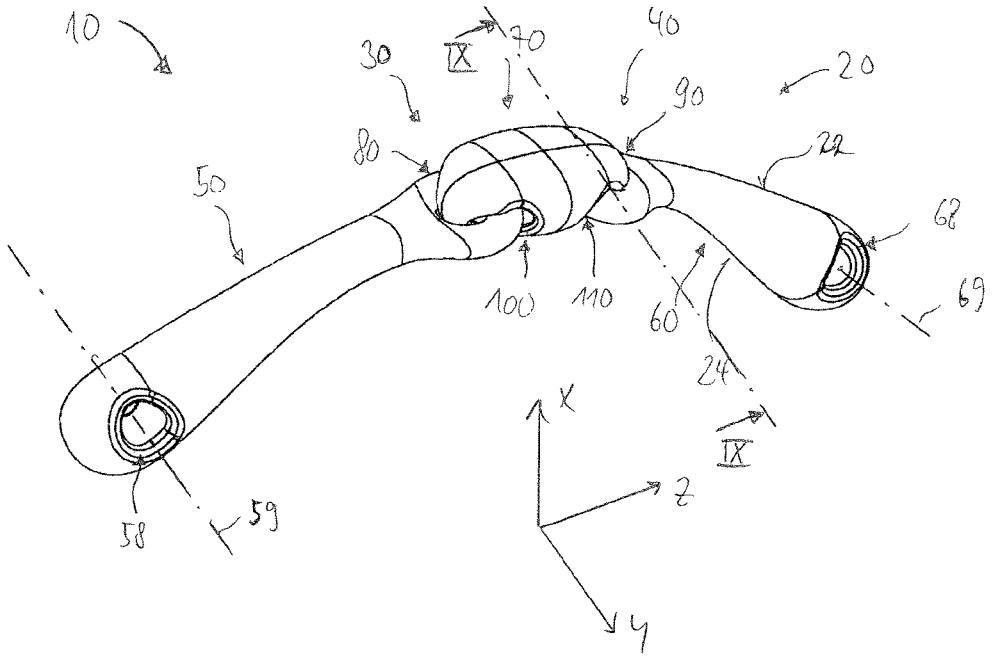
FIG. 3 is a perspective view of the first embodiment of the present invention.
Figure 5:
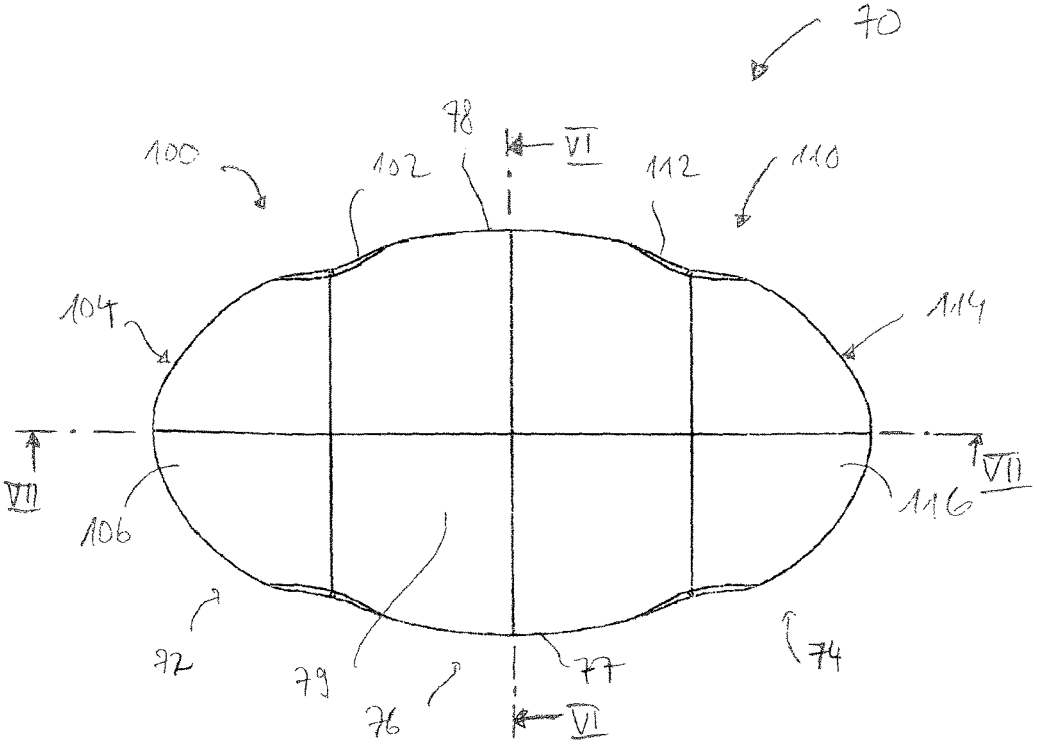
FIG. 5 is a top view of the central portion shown in FIGS. 2 and 3.
Figure 8:
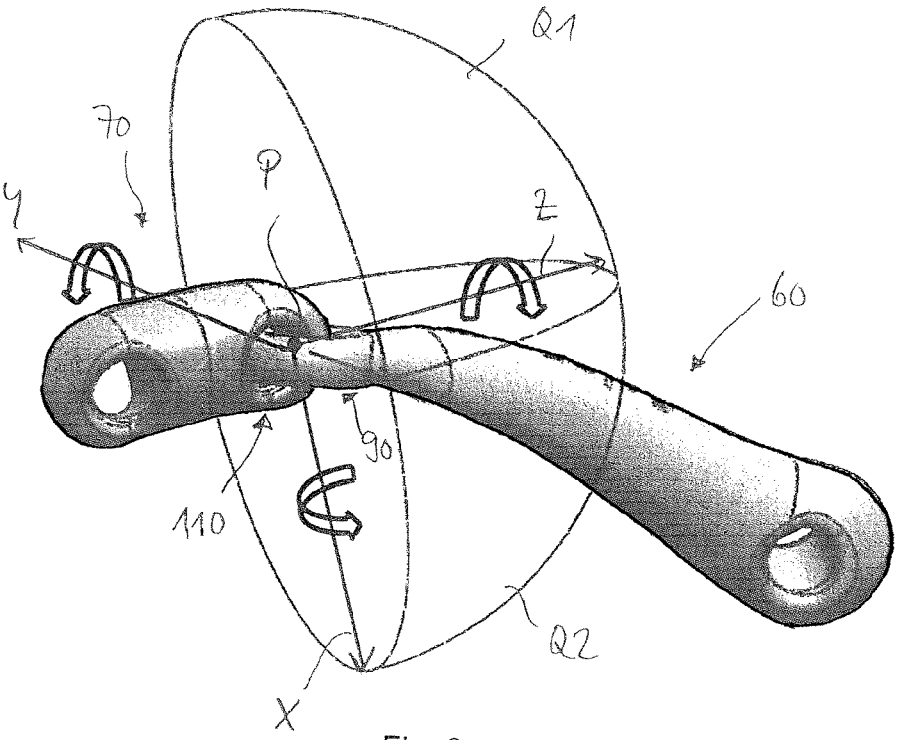
Figure 9:
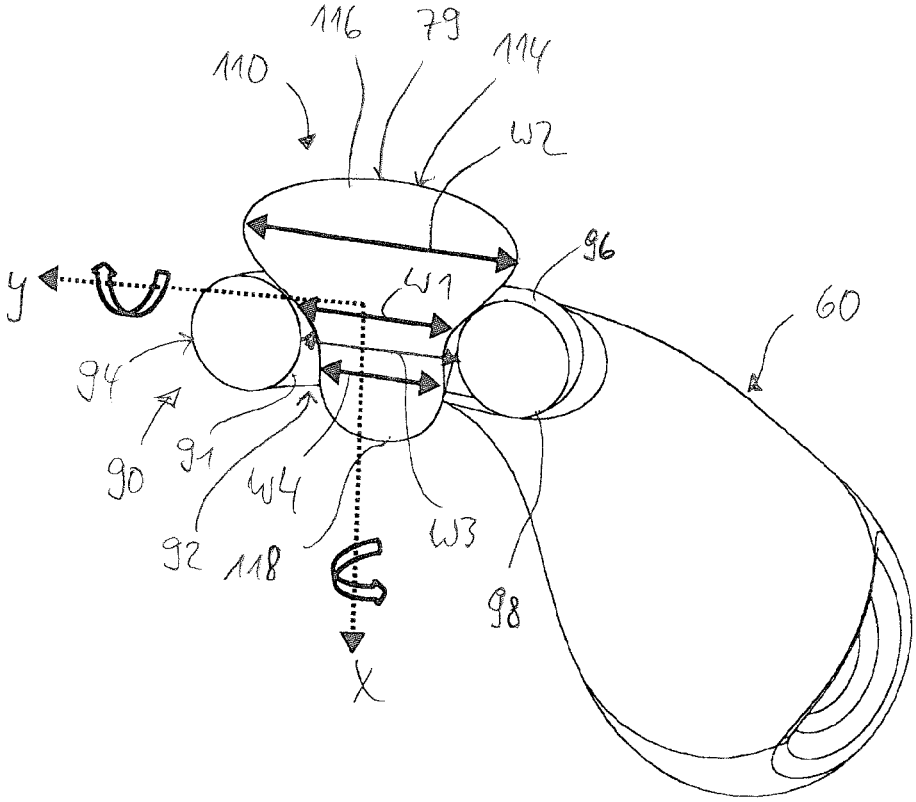
Figure 10:
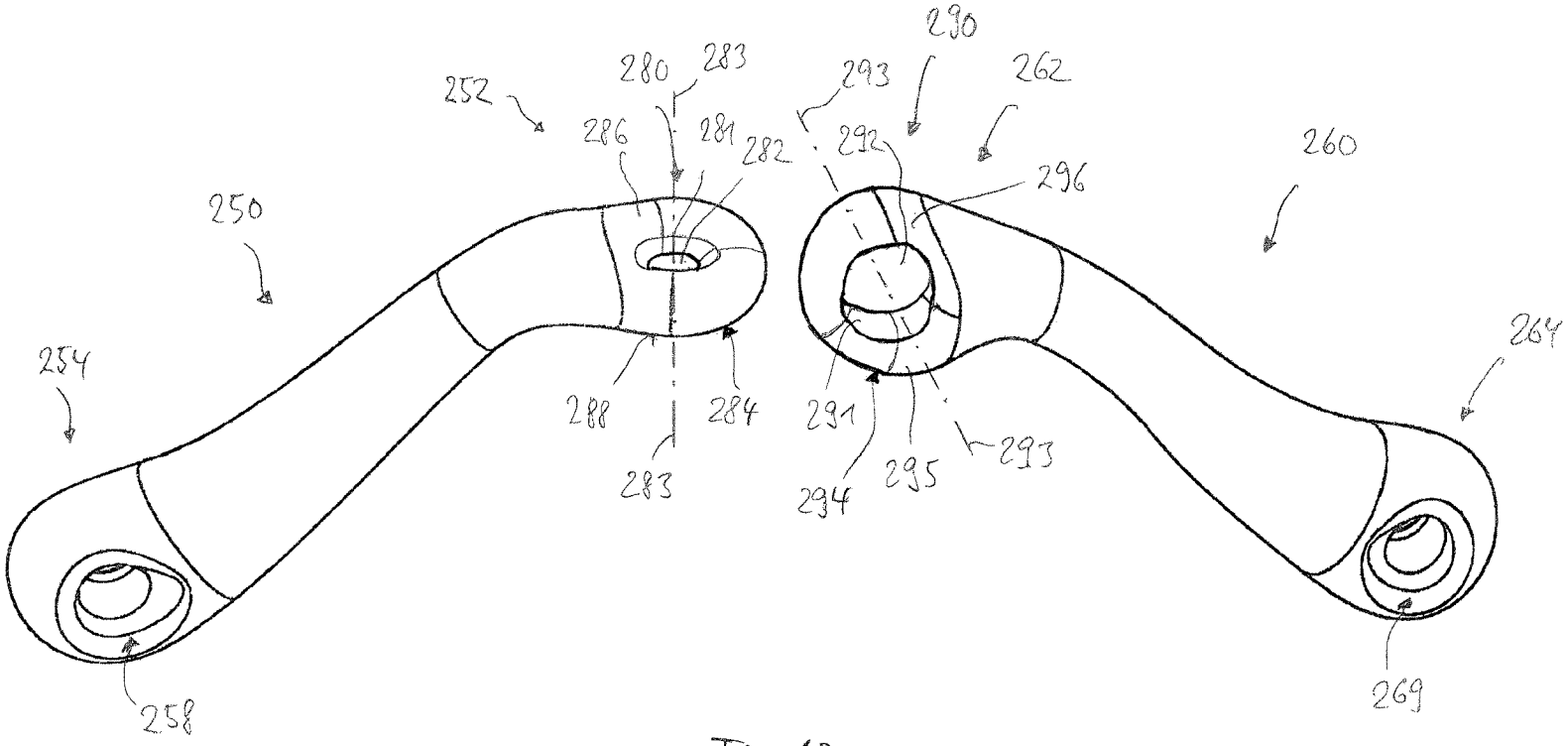
Figure 11:
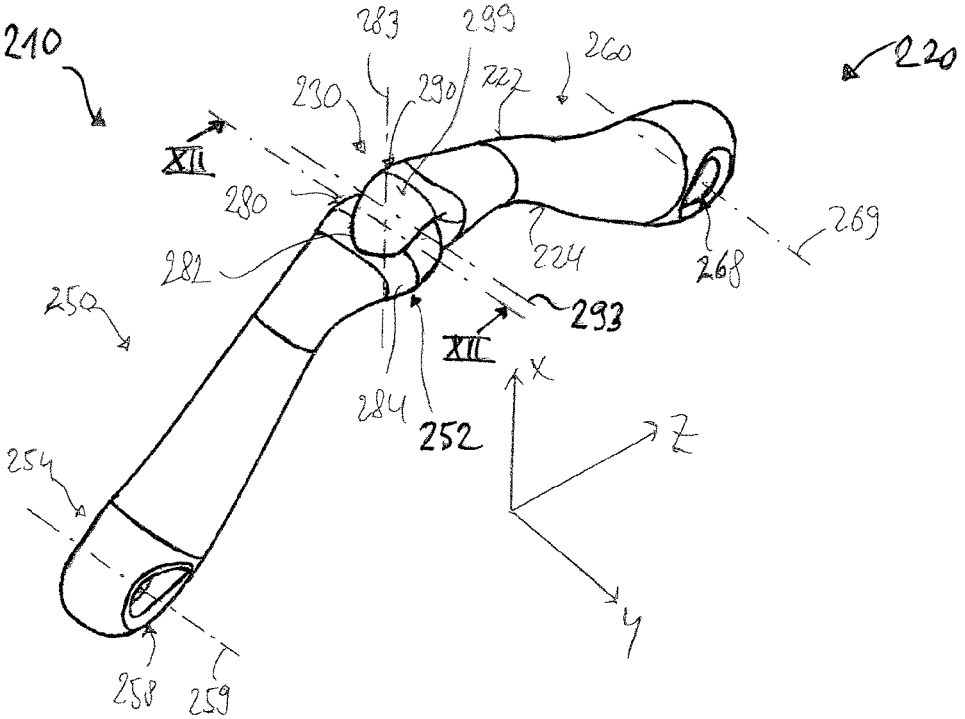
Figure 12:
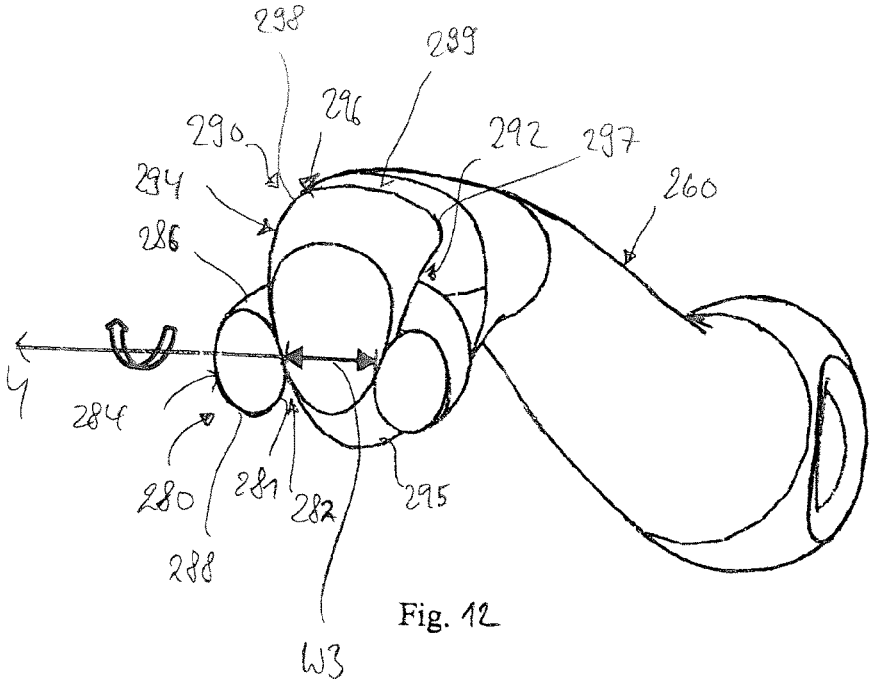

FIGS. 2 and 3 along line VII-VII in FIG. 5;

FIG. 8 is a perspective view of the first embodiment of the present invention similar to FIG. 3 but showing only one side portion and the central portion;

FIG. 9 is a perspective view of a cross-section of the first embodiment shown in FIG. 3 along line IX-IX in FIG. 3;

FIG. 10 is a perspective view of two side portions of a second embodiment of a horse bit according to the present invention;

FIG. 11 is a perspective view of the second embodiment of a horse bit according to the present invention; and FIG. 12 is a perspective view of a cross-section of the second embodiment shown in FIG. 11 along line XII-XII in FIG. 11

FIGS. 1 to 9 show a first preferred embodiment of a (double-jointed) horse bit 10 of according to a first embodiment of the present invention.

The horse bit 10 comprises a shackle 20 configured to be inserted into a horse's mouth such that the shackle 20 extends over the horse's tongue and lies between the horse's tongue and the horse's palatine. An upper side 22 of the shackle 20 faces to the horse's palatine and a lower side 24 of the shackle 20 faces to the horse's lower jaw.

The shackle 20 comprises two side portions 50, 60 and a central portion 70 between the two side portions 50, 60, wherein the two side portions 50, 60 are connected via the central portion 70 and two joints 30, 40 such that the side portions 50, 60 are pivotable to each other and/or to the central portion 70. The two joints 30, 40 connect the central portion 70 to the side portions 50, 60.

Further, the shackle 20 comprises four eyelet members 80, 90, 100, 110 each having an eyelet bore 82, 92, 102, 112. The eyelet members 80, 90, 100, 110 are interlocked with play via their eyelet bores 82, 92, 102, 112 to provide the two joints 30, 40. The eyelet members 80, 90, 100, 110 will be explained in more detail further below.

The side portion 50 has an inner end 52 comprising eyelet member 80 with eyelet bore 82. The outer end 54 of the side portion 50 includes a bore 58 having a bore axis 59. The side portion 50 extends along a length axis. The side portion 60 has an inner end 62 comprising eyelet member 90 with eyelet bore 92. The outer end 64 of the side portion 60 includes a bore 68 having a bore axis 69. The side portion 60 extends along a length axis.

Generally speaking, the shackle 20 extends in a length direction along the length axis of side portion 50, a length axis of the central portion 70 and the length axis of the side portion 60. In FIGS. 3 and 8, the shackle 20 is shown in a partly, but not fully, stretched position. As further shown in FIGS. 1 and 3, the side portions 50, 60 have a curved shape along their length axes. Preferably, the curvature is convex such that the center of curvature lies below the horse's tongue. Each side portion 50, 60 can have several adjacent sections having different but continuously merging curvatures. For example, the outer ends 54, 64 can be curved concave, the inner ends 52, 62 can be curved convex and the main section in between can be straight or curved convex or concave. Thus, the overall longitudinal axis of the shackle 20 as a whole can adopt a curved orientation in the horse's mouth.

The outer bores 58, 68 at the outer ends 54, 64 are suitable for receiving a side ring, in particular in such a manner as to allow the side ring to move freely, for connecting reins to the horse bit 10. The axes 59, 69 of the bores 58, 68 can define a plane, which preferably is horizontal. Preferably, the axes 59, 69 extend perpendicular to the longitudinal axis of each side portion 50, 60 and/or to the overall length axis of the shackle 20.

As to the above-mentioned two joints 30, 40 formed by the four eyelet members 80, 90, 100, 110, the eyelet members 80 and 100 are interlocked with play via their eyelet bores 82 and 92 to provide the joint 30 and the eyelet members 90 and 110 are interlocked with play via their eyelet bores 92 and 102 to provide the joint 40.

To this end, the inner end 52 of side portion 50 is shaped as eyelet member 80 having eyelet bore 82 with an inner surface 81. The eyelet bore 82 extends along a eyelet bore axis 83. The eyelet member 80 comprises a ring portion 84 having an upper ring section 86 and a lower ring section 88. Upper ring section 86 faces to the horse's palatine and lower ring section 88 faces to the horse's lower jaw.

Correspondingly, the inner end 62 of side portion 60 is shaped as eyelet member 90 having eyelet bore 92 with an inner surface 91. The eyelet bore 92 extends along a eyelet bore axis 93. The eyelet member 90 comprises a ring portion 94 having an upper ring section 96 and a lower ring section 98. Upper ring section 96 faces to the horse's palatine and a lower ring section 98 faces to the horse's lower jaw. The eyelet bores 82, 92 substantially have a circular shape with an inner diameter as the inner width W3. The eyelet members 80, 90 are ring-shaped and the two side portions 50, 60 are arm-shaped.

As can be seen from FIGS. 2 to 7, the end section 72 of the central portion 70 comprises eyelet member 100 with its eyelet bore 102 extending along eyelet bore axis 103. The eyelet bore 102 comprises an inner surface 101. Preferably, eyelet bore axis 103 can extend substantially parallel to bore axis 59. Preferably, eyelet bore axis 103 can extend substantially perpendicular to bore axis 83. Correspondingly, end section 74 comprises eyelet member 110 with its eyelet bore 112 extending along eyelet bore axis 113. The eyelet bore 112 comprises an inner surface 111. Preferably, eyelet bore axis 113 can extend substantially parallel to bore axis 69. Preferably, eyelet bore axis 113 can extend substantially perpendicular to bore axis 93.

To provide joint 30, the eyelet member 80 is interlocked with play with eyelet member 100. Moreover, eyelet member 90 is interlocked with play with eyelet member 110 to provide joint 40.

Referring now to FIG. 9 and according to the invention, generally speaking, in a cross section in the range of one of the eyelet members 80, 90, 100, 110 along or substantially parallel to an axis of the eyelet bore 82, 92, 102, 112 a cross-sectional width W1, W2 of the one eyelet member 80, 90, 100, 110 is larger than the inner width W3 of the eyelet bore 82, 92, 102, 112 of the other eyelet member 80, 90, 100, 110.

Figure 1:
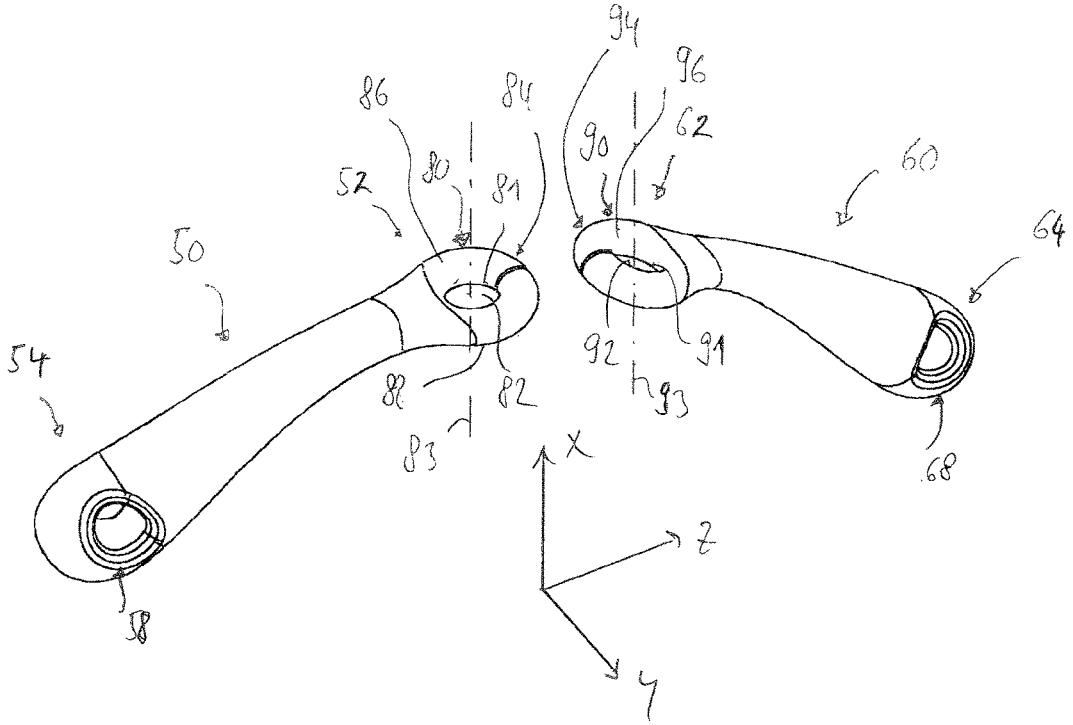

More specifically, in connection with the first embodiment, in a cross section in the range of the eyelet member 100, in particular in the range of the eyelet bore 102, along or substantially parallel to the axis of the eyelet bore 102, the cross-sectional width of the eyelet member 100 is larger than the inner width of the eyelet bore 82 of the other eyelet member 80. Preferably, the cross-sectional width is measured in a direction which is parallel to the axis of the eyelet bore 102, i.e. a direction which is parallel to the direction Y. Preferably, the plane of the cross section extends in the vertical direction X as indicated in FIG. 1. In other words, the cross-section is a vertical cross section. Alternatively, the cross-section can be defined as extending over a plane which is substantially perpendicular to the length axis of the shackle 20 and, more preferably, substantially perpendicular to the length axis of the side portion 50 (and/or 60), in particular in the range of the ring-shaped inner end 52. Also, the cross-section can be defined as extending over a plane which is substantially perpendicular to the plane of the eyelet member 80 (and/or 90).

Preferably, the cross-sectional width of the eyelet member 100 becomes larger only at one position of the eyelet member 100 when seen across the cross section. Further, the cross-sectional width of the eyelet member 100 can continuously increase over the cross-sectional height (in a direction of axis X) of the eyelet member 100.

Figure 4:
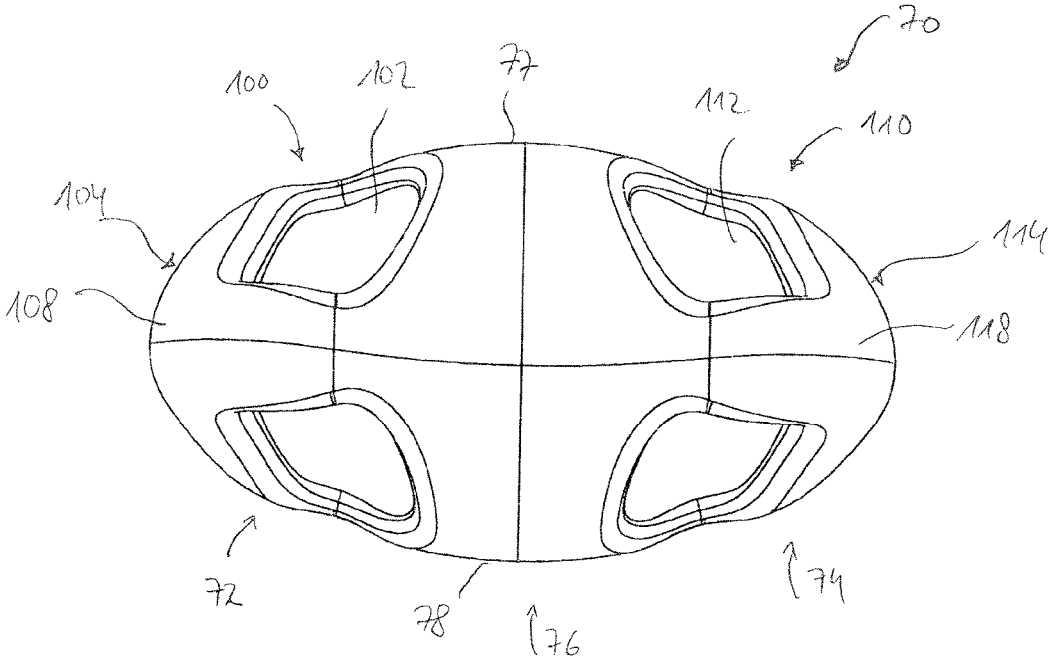
FIG. 4 is a bottom view of the central portion shown in FIGS. 2 and 3.
Figure 6:
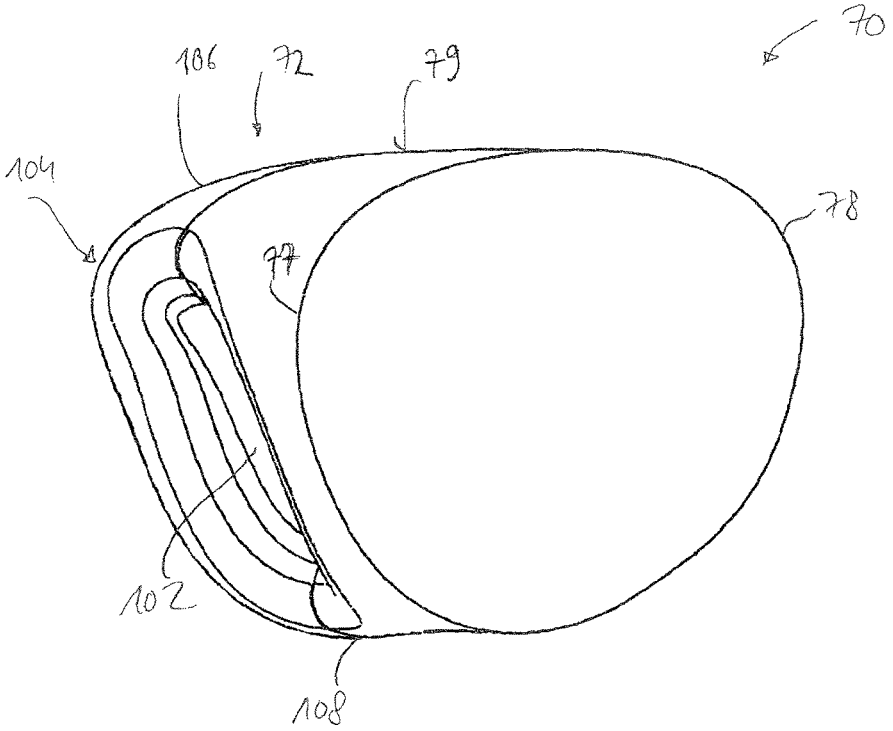
FIG. 6 is a cross-sectional view of the central portion shown in FIGS. 2 and 3 along line VI-VI in FIG. 5.
Figure 7:
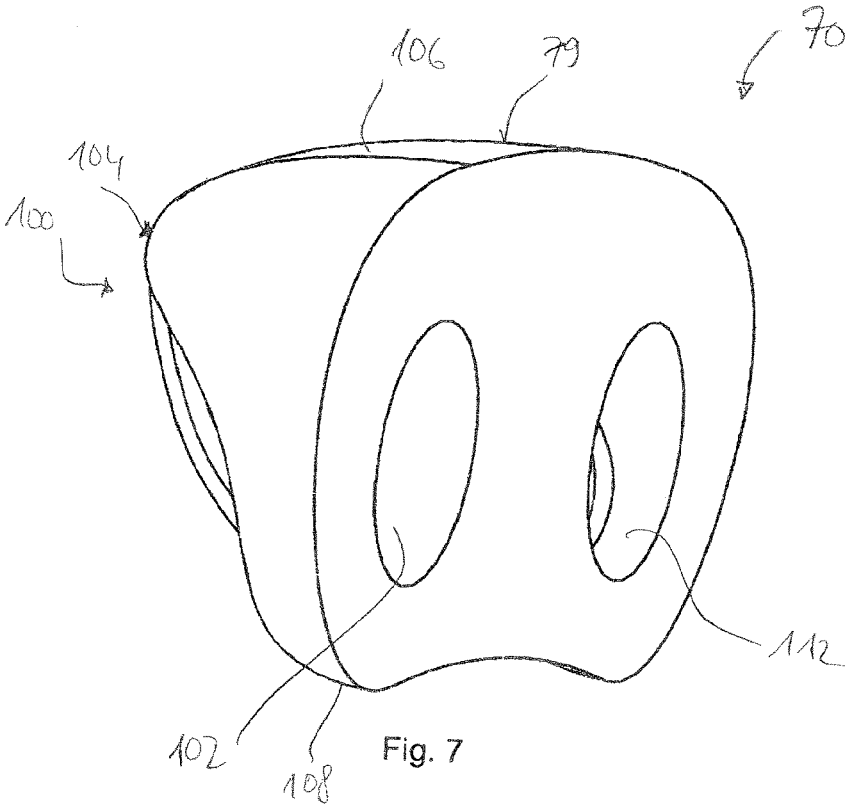

As can be taken from FIGS. 4 to 6, the width (which can also be designated as the thickness) of the upper ring section 106 is larger than a thickness of the lower ring section 108. Moreover, the thickness of the upper ring section 106 can be larger than a thickness (or outer diameter) of the eyelet member 80.

Due to the symmetrical configuration of the side portions 50, 60 and the central portion 70, the above explanations as to the cross section in the range of eyelet member 100 and 80 and the corresponding relationship between the widths (or thicknesses) apply in the same manner also to the cross section in the range of eyelet member 110 and 90 and the parts concerned.

Further, the cross-sectional width of the central portion 70 is further formed by two projection sections 77, 78. Each projection section 77, 78 is connected to eyelet members 100, 110. In other words, the projection sections 77, 78 are provided by the central section 76 of the central portion 70. The projection sections extend substantially parallel to the axis 103, 113 of the eyelet bores 102, 112.

This enables the further advantage that the central portion 70 has a top surface 79 (related to the horse palatine) which is flattened and which is enlarged compared to the end sections 72, 74 and/or the eyelet members 80, 90 of the side portions 50, 60. Moreover, the curved shape, preferably the convex curvature, prevent any sharp edges. The shape of the central portion 70 is particularly preferred due to the provision of an enlarged, flattened and/or curved upper surface 79 to reduce the pressure that may be applied to the sensitive roof of the mouth of the horse. Removing pressure from the roof of the mouth is a beneficial feature for the comfort of the horse.

The thickness of ring portion 84 is preferably in a range of between about more than 75% and less than 100% of the diameter of the eyelet bore 102 and more preferably in a range of between about more than 80% and less than 95% of the diameter of the eyelet bore 102. The same may apply to ring portions 94 and 114. Moreover, the inner diameter of the eyelet bore 82 is preferably in a range of between about more than 75% and less than 100% of the diameter of the eyelet bore 102 and more preferably in a range of between about more than 80% and less than 95% of the diameter of the eyelet bore 102. The same may apply to eyelet bores 92 and 112.

FIG. 8 shows side portion 60 connected to the central portion 70 overlaid with a hemisphere depicting two quadrants Q1, Q2 of a full sphere that contains all possible angles of rotation of the side portion 60 around a mating point P relative to the central portion 70. Side portion 50 has been removed only for the sake of better visibility.

In FIG. 8, cartesian axes X, Y, Z are shown around which rotations of the side portion 60 relative to the central portion 70 are allowed and are depicted by curved arrows. The axis Y then lies in a plane parallel to the reference plane and above it and points between the horse's nose and ears. The axis X is orthogonal to Y and points between the roof of the mouth and the lower jaw. The direction X is defined as the vertical direction having positive scalar values inside the upper quadrant Q1 and negative scalar values in the lower quadrant Q2. The axis Z lies in the same plane as Y and is orthogonal to both X and Y.

Axes X, Y, Z share a common origin defined as the mating point P of the joint 40 around which rotations of the side portion 60 relative to the center portion 70 may be allowed. The mating point P is a point or position where the inner surfaces 91, 111 of the eyelet members 90, 110 contacts, preferably in a at least partially stretched position of the shackle 20.

The mating point P can be used to define the origin or center of a sphere or hemisphere within which the lower quadrant Q2 and upper quadrant Q1 contain a range of possible three dimensional rotation angles obtained by vector projection from the origin P onto the axes X, Y and Z.

It will be apparent to a skilled person that the same applies in a manner re-versed right to left to the other side portion 50 also resulting in an upper and lower quadrant.

In all known horse bits of the double joint type known, the side portions are each free to rotate into angles contained in both quadrants of the hemisphere giving considerable freedom of movement to the side parts.

However, this freedom allows the horse who wishes to evade the contact of the bit to rotate the side portions into angles contained in the upper quadrant using the tongue and to transfer the whole of the shackle/mouthpiece backwards in the mouth away from the region of the upper and lower jaws of the mouth unoccupied by teeth the so-called "bars" of the mouth and into the region of the upper and lower jaw occupied by teeth. The horse can then clamp the mouthpiece using the teeth preventing the commands from being conveyed by the rider to the horse. Such a situation can be as unimportant as a mild inconvenience through to a serious safety issue when speed and directional control is lost.

Double jointed horse bits have suffered from this serious deficiency and that is what the invention seeks to rectify. Having identified that it is this lifting of the side portions 50, 60 that is responsible for this undesired behaviour the invention provides a centre portion 70 that retains all the desired movement of the bit 10 required for its function but specifically restricts the movement that causes the problems identified.

In the present first embodiment of the invention the centre portion 70 becomes a controlling part and when connected to the side portion 60 (and/or 50) that becomes a controlled part and the effect is to prevent rotations of the controlled part into angles contained within quadrant Q1.

Still referring to FIG. 8, the range of angles of free rotation around Y depends upon the relative dimensions of the internal diameter (or width) of the eyelet bore 92 of side portion 60 and the cross-sectional width (or thickness) of the eyelet member 110 at the end section 74 of the central portion 70 that receives the eyelet member 90 of side portion 60 to form the joint 40.

The cross-sectional width tapers or otherwise varies when projected along the X axis. Therefore, the extent of free rotation of the side portion 60 (and/or 50) around Y will be bounded within a range of rotation angles around the mating point P. At any of these angles the two parts 60 and 70 are connected only at the single mating point P that provides a pivot point for rotation. As the rotation angles tend towards those where the contact between the two parts 60, 70 is on more points than the single pivot point physical interference between the two parts prevents further rotation.

FIGS. 10 to 12 show a single-jointed horse bit 210 according to a second embodiment of the present invention.

The horse bit 210 comprises a shackle 220 configured to be inserted into a horse's mouth such that the shackle 220 extends over the horse's tongue and lies between the horse's tongue and the horse's palatine. An upper side 222 of the shackle 220 faces to the horse's palatine and a lower side 224 of the shackle 220 faces to the horse's lower jaw.

The shackle 220 comprises one single joint 230 and two side portions 250, 260, wherein the two side portions 250, 260 are connected by joint 230 such that the side portions 250, 260 are pivotable to each other.

Further, the shackle 220 comprises two eyelet members 280, 290 each having an eyelet bore 282, 292. The eyelet members 280, 290 are interlocked with play via their eyelet bores 282, 292 to provide the joint 230. The eyelet members 280, 290 will be explained in more detail further below.

The side portion 250 has an inner end 252 comprising eyelet member 280 with eyelet bore 282. The outer end 254 of the side portion 250 includes a bore 258 having a bore axis 259. The side portion 250 extends along a length axis. The side portion 260 has an inner end 262 comprising eyelet member 290 with eyelet bore 292. The outer end 264 of the side portion 260 includes a bore 268 having a bore axis 269. The side portion 260 extends along a length axis.

Generally speaking, the shackle 220 extends in a length direction along the length axis of side portion 250 and the length axis of the side portion 260. In FIGS. 9 to 11, the shackle 220 is shown in a partly, but not fully, stretched position. As further shown, the side portions 250, 260 have a curved shape along their length axes. Preferably, the curvature is convex or concave. Each side portion 250, 260 can have several adjacent sections having different but continuously merging curvatures. Thus, the overall longitudinal axis of the shackle 220 as a whole can adopt a curved orientation in the horse's mouth.

The bores 258, 268 at the outer ends 254, 264 are suitable for receiving a side ring, in particular in such a manner as to allow the side ring to move freely, for connecting reins to the horse bit 210. The axes 259, 269 of the bores 258, 268 can define a plane, which preferably is horizontal. Preferably, the axes 259, 269 extend perpendicular to the longitudinal axis of each side portion 250, 260 and/or to the overall length axis of the shackle 220.

The above-mentioned joint 230 is formed by the two eyelet members 280, 290 which are interlocked with play via their eyelet bores 282 and 292 to provide the joint 230.

To this end, the inner end 252 of side portion 250 is shaped as eyelet member 280 having eyelet bore 282 with an inner surface 281. The eyelet bore 282 extends along a eyelet bore axis 283. The eyelet member 280 comprises a ring portion 284 having an upper ring section 286 and lower ring section 288. Upper ring section 286 faces to the horse's palatine and a lower ring section 288 faces to the horse's lower jaw.

Correspondingly, the inner end 262 of side portion 260 is shaped as eyelet member 290 having eyelet bore 292 with an inner surface 291. The eyelet bore 292 extends along a eyelet bore axis 293. The eyelet member 290 comprises a ring portion 294 having an upper ring section 296 and lower ring section 295. Upper ring section 296 faces to the horse's palatine and a lower ring section 295 faces to the horse's lower jaw. The eyelet bores 282, 292 substantially have a circular shape with an inner diameter as the inner width. The eyelet members 280, 290 are ring-shaped and the two side portions 250, 260 are arm-shaped.

Preferably, eyelet bore axis 283 can extend substantially perpendicular to bore axis 293. As can be seen from FIGS. 10 to 12, eyelet bore axis 283 can extend substantially in direction X and eyelet bore axis 293 can extend substantially in direction Y.

According to the invention, generally speaking, in a cross section in the range of one of the eyelet members 280, 290 along or substantially parallel to an axis of the eyelet bore 282, 292 a cross-sectional width W1, W2 of the one eyelet member 280, 290 is larger than the inner width W3 of the eyelet bore 282, 292 of the other eyelet member 280, 290.

More specifically, in connection with the present second embodiment, in a cross section in the range of the eyelet member 280, in particular in the range of the eyelet bore 282, along or substantially parallel to axis of the eyelet bore 282 the cross-sectional width of the eyelet member 290 is larger than the inner width of the eyelet bore 282 of the other eyelet member 280.

Preferably, the cross-sectional width is measured in a direction which is parallel to the axis of the eyelet bore 292, i.e. a direction which is parallel to the direction Y. Preferably, the plane of the cross section extends in the vertical direction X. In other words, the cross-section is a vertical cross section. Alternatively, the cross-section can be defined as extending over a plane which is substantially perpendicular to the length axis of the shackle 220 and, more preferably, substantially perpendicular to the length axis of the side portion 250 (and/or 260), in particular in the range of the ring-shaped inner end 252. Also, the cross-section can be defined as extending over a plane which is substantially perpendicular to the plane of the eyelet member 280 (and/or 290).

Preferably, the cross-sectional width of the eyelet member 290 becomes larger only at one position of the eyelet member 290 when seen across the cross section. Further, the cross-sectional width of the eyelet member 290 can continuously increase over the cross-sectional height (in a direction of axis X) of the eyelet member 290.

As can be taken from FIGS. 10 to 12, the width (can also be designated as the thickness) of the upper ring section 296 is larger than a thickness of the lower ring section 295.

Further, as can be taken from FIG. 12, the thickness of the ring portion 294 is continuously increasing along the longitudinal ring-shaped extension axis of the ring portion 294.

In other words, the upper ring section 296 can be understood as formed by two projection sections 297, 298. Each projection section 297, 298 is provided by the upper ring section 296 of the ring portion 294. The projection sections 297, 298 extend substantially parallel to the axis 293 of the eyelet bore 292.

Preferably, the eyelet member 290 has a top surface 299 (related to the horse palatine) which is flattened, curved and/or enlarged compared to the side portions 250, 260, in particular compared to their middle portions (between the inner and out end of the respective side portion). Moreover, the curved shape, preferably the convex curvature, prevent any sharp edges.

The enlarged, flattened and/or curved upper surface 299 reduces the pressure that may be applied to the sensitive roof of the mouth of the horse.

| List of Reference Signs | |
|---|---|
| 10 | horse bit |
| 20 | shackle |
| 22 | upper side |
| 24 | lower side |
| 30 | joint |
| 40 | joint |
| 50 | side portion |
| 52 | inner end |
| 54 | outer end |
| 58 | bore |
| 59 | bore axis |
| 60 | side portion |
| 62 | inner end |
| 64 | outer end |
| 68 | bore |
| 69 | bore axis |
| 70 | central portion |
| 72 | end section |
| 74 | end section |
| 76 | central section |
| 77 | projection section |
| 78 | projection section |
| 79 | top surface |
| 80 | eyelet member |
| 81 | inner surface |
| 82 | eyelet bore |
| 83 | eyelet bore axis |
| 84 | ring portion |
| 86 | upper ring section |
| 88 | lower ring section |
| 90 | eyelet member |
| 91 | inner surface |
| 92 | eyelet bore |
| 93 | eyelet bore axis |
| 94 | ring portion |
| 96 | upper ring section |
| 98 | lower ring section |
| 100 | eyelet member |
| 101 | inner surface |
| 102 | eyelet bore |
| 103 | eyelet bore axis |
| 104 | ring portion |
| 106 | upper ring section |
| 108 | lower ring section |
| 110 | eyelet member |
| 111 | inner surface |
| 112 | eyelet bore |
| 113 | eyelet bore axis |
| 114 | ring portion |
| 116 | upper ring section |
| 118 | lower ring section |
| 210 | horse bit |
| 220 | shackle |
| 222 | upper side |
| 224 | lower side |
| 230 | joint |
| 250 | side portion |
| 252 | inner end |
| 254 | outer end |
| 258 | bore |
| 259 | bore axis |
| 260 | side portion |
| 262 | inner end |
| 264 | outer end |
| 268 | bore |
| 269 | bore axis |
| 280 | eyelet member |
| 281 | inner surface |
| 282 | eyelet bore |
| 283 | eyelet bore axis |
| 284 | ring portion |
| 286 | upper ring section |
| 288 | lower ring section |
| 290 | eyelet member |
| 291 | inner surface |
| 292 | eyelet bore |
| 293 | eyelet bore axis |
| 294 | ring portion |
| 295 | lower ring section |

-continued

| List of Reference Signs | |
|---|---|
| 296 | upper ring section |
| 297 | projection section |
| 298 | projection section |
| 299 | top surface |
| X | axis |
| Y | axis |
| Z | axis |
| W1 | cross-sectional width |
| W2 | cross sectional width |
| W3 | inner width |
| W4 | cross sectional width |
| P | mating point (origin) |
| Q1 | upper quadrant |
| Q2 | lower quadrant |

The invention claimed is:

1. A horse bit comprising a shackle configured to be inserted into a horse's mouth, the shackle comprising:

at least one joint and two side portions, wherein the two side portions are connected by the at least one joint such that the two side portions are pivotable relative to each other, and at least two eyelet members each having an eyelet bore, wherein the at least two eyelet members are interlocked with play via their eyelet bores to provide the at least one joint, wherein, in a cross section of one eyelet member of the at least two eyelet members along or substantially parallel to an axis of the eyelet bore of the one eyelet members a cross-sectional width of the one eyelet member is larger than an inner width of the eyelet bore of another eyelet member of the at least two eyelet members, wherein an angular range of free rotation of each of the two side portions lies within only a lower quadrant of a hemisphere whose origin lies at a mating point where inner surfaces of the eyelet bores interlock and contact each other to form the at least one joint.

2. The horse bit of claim 1, in which the cross-sectional width of the one eyelet member is equal to or larger at one position than at other positions of the cross-sectional height of the eyelet member.

3. The horse bit of claim 1, in which the cross-sectional width of the one eyelet member is continuously increasing over the cross-sectional height of the one eyelet member.

4. The horse bit of claim 1, in which at least one of the eyelet members includes a ring portion having an upper ring section related to the roof of the horse's mouth and a lower ring section related to the lower jaw of the horse's mouth, wherein a thickness of the upper ring section is larger than a thickness of the lower ring section.

5. The horse bit of claim 4, in which the thickness of the upper ring section and the thickness of the lower ring section are continuously increasing along a longitudinal extension axis of the ring portion.

6. The horse bit of claim 1, in which the at least one of the eyelet members is at least partially ring-shaped and at least one of the eyelet bores has a substantially circular shape with an inner diameter as the inner width of the at least one of the eyelet bores.

7. The horse bit of claim 6, in which the at least two side portions are arm-shaped.

8. The horse bit of claim 1, in which the cross-sectional width is formed by at least one projection section provided by or connected to one of the eyelet members.

9. The horse bit of claim 8, in which the at least one projection section extends substantially parallel to the axis of one of the eyelet bores.

10. The horse bit of claim 1, in which the cross-sectional width of the one eyelet member is variable over the plane of the cross section, wherein a first cross-sectional width is at least 50% of the inner width of the eyelet bore of the other eyelet member, and wherein a second cross-sectional width is more than 100% of the inner width of the eyelet bore of the other eyelet member, and wherein over a section in the plane of the cross-section between the first and second cross-sectional width a third cross-sectional width corresponds to the inner width of the eyelet bore of the other eyelet member.

11. The horse bit of claim 10, in which the first cross-sectional width is at least 75% of the inner width of the eyelet bore of the other eyelet member and wherein the second cross-sectional width is more than 125% of the inner width of the eyelet bore of the other eyelet member.

12. The horse bit of claim 10, in which the first cross-sectional width is at least 90% of the inner width of the eyelet bore of the other eyelet member and wherein the second cross-sectional width is more than 150% of the inner width of the eyelet bore of the other eyelet member.

13. The horse bit of claim 10, in which the first cross-sectional width is a minimum cross-sectional width of the one eyelet member, and the second cross-sectional width is a maximum cross-sectional width of the one eyelet member.

14. The horse bit of claim 13, in which the third cross-sectional width is a cross-sectional width that is identical to the inner width of the eyelet of the other eyelet member.

15. The horse bit of claim 1, in which the at least one joint comprises one joint, wherein the two side portions are connected by the joint and each side portion having an inner end with one eyelet member having the eyelet bore, wherein the at least two two eyelet members are interlocked with play via their eyelet bores to provide the joint.

16. The horse bit of claim 15, in which one of the inner ends of the side portions has a top surface related to a horse palatine wherein the top surface is at least one of flattened, curved, and enlarged.

17. The horse bit of claim 1, in which an angular range of free rotation of each of the two side portions lies within a single quadrant of a hemisphere whose origin lies at a mating point where inner surfaces of the eyelet bores interlock and contact each other to form the joint.

18. A horse bit comprising a shackle configured to be inserted into a horse's mouth, the shackle comprising, two joints and two side portions; and a central portion between the two side portions, the two joints connecting the central portion to the two side portions such that the two side portions are pivotable relative to the central portion, wherein each of the two side portions have an inner end with an eyelet member having an eyelet bore, wherein the central portion has two end sections, each of the two end sections of the central portion having an eyelet member with an eyelet bore, wherein each of the eyelet members of the central portion is interlocked with play with the adjacent eyelet member of the two side portions to provide the two joints, and wherein an angular range of free rotation of each of the two side portions lies within only a lower quadrant of a hemisphere whose origin lies at a mating point where inner surfaces of the eyelet bores of the two side portions interlock and contact inner surfaces of the eyelet bores of the central portion to form the two joints.

19. The horse bit of claim 18, in which the central portion has a top surface related to a horse palatine wherein the top surface is at least one of flattened, curved, and enlarged.

* * * * *